US010071269B2

(12) United States Patent
VanBuren

(10) Patent No.: US 10,071,269 B2
(45) Date of Patent: Sep. 11, 2018

(54) METHOD AND APPARATUS FOR APPLYING ROCK DUST TO A MINE WALL

(71) Applicant: Rusmar Incorporated, West Chester, PA (US)

(72) Inventor: Ricky VanBuren, LaPlata, NM (US)

(73) Assignee: Rusmar Incorporated, West Chester, PA (US)

( * ) Notice: Subject to any disclaimer, the term of this patent is extended or adjusted under 35 U.S.C. 154(b) by 1442 days.

(21) Appl. No.: 13/736,112

(22) Filed: Jan. 8, 2013

(65) Prior Publication Data

US 2013/0277072 A1 Oct. 24, 2013

Related U.S. Application Data

(60) Provisional application No. 61/585,812, filed on Jan. 12, 2012.

(51) Int. Cl.

| | |
|---|---|
| ***A62C 3/02*** | (2006.01) |
| ***A62C 5/02*** | (2006.01) |
| ***E21F 5/10*** | (2006.01) |

(52) U.S. Cl.

CPC ..... *A62C 3/02* (2013.01); *A62C 3/0221* (2013.01); *E21F 5/10* (2013.01); *A62C 5/022* (2013.01)

(58) Field of Classification Search

CPC ..... A62C 3/02; A62C 3/0221; A62C 5/022; E21F 5/10; E21F 5/08; E21F 5/00

USPC ..... 169/44, 64; 299/12; 252/88.1

See application file for complete search history.

(56) References Cited

U.S. PATENT DOCUMENTS

| | | | | | |
|---|---|---|---|---|---|
| 1,954,154 | A * | 4/1934 | Urquhart | A62C 5/002 | 169/15 |
| 2,146,605 | A * | 2/1939 | Timpson | A62C 5/002 | 169/15 |
| 2,361,980 | A * | 11/1944 | Tirrell | A62D 1/0071 | 169/15 |
| 4,155,508 | A * | 5/1979 | Fiorentini | B29B 7/7615 | 239/118 |
| 4,394,975 | A * | 7/1983 | Bare, Jr. | E21F 5/10 | 239/143 |
| 4,538,941 | A * | 9/1985 | Thorne | B65G 53/42 | 406/143 |
| 4,805,702 | A * | 2/1989 | White | A62C 3/02 | 169/45 |
| 4,874,641 | A | 10/1989 | Kittle | | |
| 5,096,616 | A | 3/1992 | Kittle | | |
| 5,143,645 | A * | 9/1992 | Roe | C04B 7/48 | 252/382 |
| 5,167,285 | A * | 12/1992 | Williams | A62C 31/07 | 169/14 |
| 5,215,786 | A * | 6/1993 | Kittle | A62D 1/0071 | 252/3 |
| 5,232,279 | A * | 8/1993 | Boberg | B28C 5/383 | 366/22 |

(Continued)

*Primary Examiner* — Darren W Gorman
*Assistant Examiner* — Steven M Cernoch
(74) *Attorney, Agent, or Firm* — Howson & Howson, LLP

(57) ABSTRACT

Rock dust is applied to a mine wall for mine fire suppression in combination with a chemical foam, by generating the foam from air and a foamable liquid in a mixing chamber, and delivering the foam through one flexible conduit and air-entrained rock dust through another flexible conduit to a portable assembly composed of a Y-joint and a delivery nozzle for combining the foam and rock dust and applying the combination directly to a mine wall.

12 Claims, 3 Drawing Sheets

(56) References Cited

U.S. PATENT DOCUMENTS

| | | | | |
|---|---|---|---|---|
| 6,135,368 | A * | 10/2000 | Protan | E21F 5/10 239/143 |
| 6,431,465 | B1 * | 8/2002 | Yie | A62C 5/008 169/33 |
| 6,726,489 | B2 * | 4/2004 | Kappel | H01R 43/26 439/66 |
| 6,726,849 | B2 | 4/2004 | Gay | |
| 6,929,423 | B2 * | 8/2005 | Kittle | B09B 1/00 405/129.25 |
| 6,994,491 | B2 * | 2/2006 | Kittle | B09B 1/00 405/129.25 |
| 7,530,404 | B2 | 5/2009 | Lenz, Jr. | |
| 8,003,001 | B1 | 8/2011 | Kaiser et al. | |
| 8,584,974 | B2 * | 11/2013 | Masloff | E21F 5/10 239/126 |
| 8,622,144 | B2 | 1/2014 | Davis et al. | |
| 8,883,868 | B2 * | 11/2014 | Masloff | C08J 9/30 169/46 |
| 2003/0146410 | A1 * | 8/2003 | Gay | A62D 1/0014 252/88.1 |
| 2010/0186971 | A1 * | 7/2010 | Seyffert | A62C 31/22 169/13 |
| 2011/0203813 | A1 * | 8/2011 | Fenton | A61L 2/22 169/46 |
| 2012/0111583 | A1 * | 5/2012 | Brown | E21F 5/12 169/45 |
| 2012/0205129 | A1 * | 8/2012 | Hussey | A62C 3/00 169/44 |
| 2014/0265523 | A1 | 9/2014 | Wright | |
| 2015/0114671 | A1 | 4/2015 | VanBuren | |
| 2015/0115690 | A1 | 4/2015 | VanBuren | |

* cited by examiner

METHOD AND APPARATUS FOR APPLYING ROCK DUST TO A MINE WALL

FIELD OF THE INVENTION

This invention relates generally to coal mining, and more particularly to the application of rock dust to a mine wall for the purpose of suppressing mine fires and preventing explosions.

BACKGROUND OF THE INVENTION

In coal mining, it has been common practice to apply limestone in the form of a dust to the walls of a mine, thereby causing the limestone to adhere to the walls. The process, known as "rock dusting," has two effects. First, because the limestone dust covers exposed surfaces of unmined coal, it prevents mine fires from being propagated along those exposed surfaces. Second, if methane, coal dust, or a mixture of methane and coal dust, ignite in a mine causing an explosion, the rock dust adhering to the mine wall will become airborne, and suppress the propagation of fire resulting from the explosion.

The United States Mine Safety and Health Administration has established standards for rock dusting, which include a requirement that all exposed surfaces of a mine be covered with rock dust at least 80%; of the content of which is non-combustible. Existing methods for applying rock dust include application of rock dust to a mine wall. Recently, mines have begun using chemical foam to achieve improved adhesion of the rock dust to mine surfaces. One method of using foam in rock dust application is to apply a dry mixture of rock dust and a foaming agent to a mine wall. Another method is to apply a mixture of foam and rock dust to a mine wall. In the last-mentioned method, the foam is formed, mixed with rock dust in a mixing vessel, and pumped through a conduit to the point of application. A system for utilizing foam to enhance the adhesion of rock dust to a mine wall is described in U.S. Pat. No. 6,726,849, granted Apr. 27, 2004.

SUMMARY OF THE INVENTION

The invention is a method and apparatus, different from those previously used. One difference, which allows a number of advantages to be realized, is that in the method according to the invention, rock dust and foam are combined at the point of application to the mine wall.

In accordance with one aspect of the invention, an apparatus for applying rock dust to a mine wall comprises first and second conduits. Means are provided for entraining rock dust in air in the first conduit, and means are provided for mixing a foamable liquid and air to produce a flowable foam, and for delivering the flowable foam through the second conduit. Means are also provided for combining rock dust and air taken from the first conduit with flowable foam taken from the second conduit. A nozzle connected to the combining means is provided for applying a mixture of air, rock dust and foam from the combining means to a mine wall.

In a preferred embodiment, the apparatus comprises the following interrelated elements. A vessel for temporarily containing rock dust is connected to receive rock dust from a supply thereof. A first source of compressed air is connected to the vessel, and a first conduit connected to the vessel is provided for carrying air, along with rock dust entrained therein, from the vessel. A first control means is provided for regulating the concentration of rock dust in the air carried by the first conduit. The apparatus also includes a mixing block for mixing a foamable liquid and air to produce a flowable foam. A pump, connected to a supply of foamable liquid and to the mixing block delivers the foamable liquid to the mixing block. A second source of compressed air is connected to the mixing block to supply air to the mixing block. A second control means is provided for independently controlling the rates at which foamable liquid and air are supplied to the mixing block. A second conduit is provided for carrying flowable foam from the mixing block to a Y-joint. The Y-joint has a first inlet connected to the first conduit for receiving rock dust and air, and a second inlet connected to the second conduit for receiving flowable foam. A mixture of air, rock dust and foam is delivered through an outlet of the Y-joint to a nozzle used to apply the mixture of air, rock dust and foam to a mine wall.

Various kinds of pumps can be used to deliver the foamable liquid to the mixing block. For example, the pump can be an air-driven pump connected to be driven by air from the second source of compressed air. In this case, the second control means preferably comprises a first adjustable valve for controlling the supply of air to the pump and a second adjustable valve for controlling the supply of air to the mixing block. Because the air-driven pump is operated by air from the same source that supplies air to the mixing block, the system compensates automatically for changes in the air pressure at the second source, reducing the flow of foamable liquid when the air flow rate decreases as a result of a drop in air pressure at the source, and increasing the flow of foamable liquid when the air flow rate increases as a result of an increase in air pressure at the source.

In another aspect, the invention is a method of applying rock dust to a mine wall. In accordance with the method rock dust is entrained in air in a first conduit. A foamable liquid and air are mixed to produce a flowable foam, which is delivered through a second conduit. The combination of rock dust and air from the first conduit and the flowable foam from said second conduit are combined in a Y-joint having an outlet. A mixture of rock dust, air and foam are thereby caused to flow through the outlet and applied through a nozzle to a mine wall.

The method and apparatus in accordance with the invention can utilize existing rock dust application equipment. The method and apparatus can also avoid the time-consuming and difficult process of mixing of foam and rock dust in a mixing vessel and delivery of the mixture over long distances from the mixing tank to a mine wall. The method and apparatus are also superior to alternatives in which a dry composition of rock dust and foaming agent are applied to a wet mine wall, and to alternatives in which foam and rock dust are applied to a mine wall in separate steps.

Further advantages of the invention will be apparent from the following description when read in conjunction with the drawings.

DETAILED DESCRIPTION OF THE PREFERRED EMBODIMENTS

Figure 1:
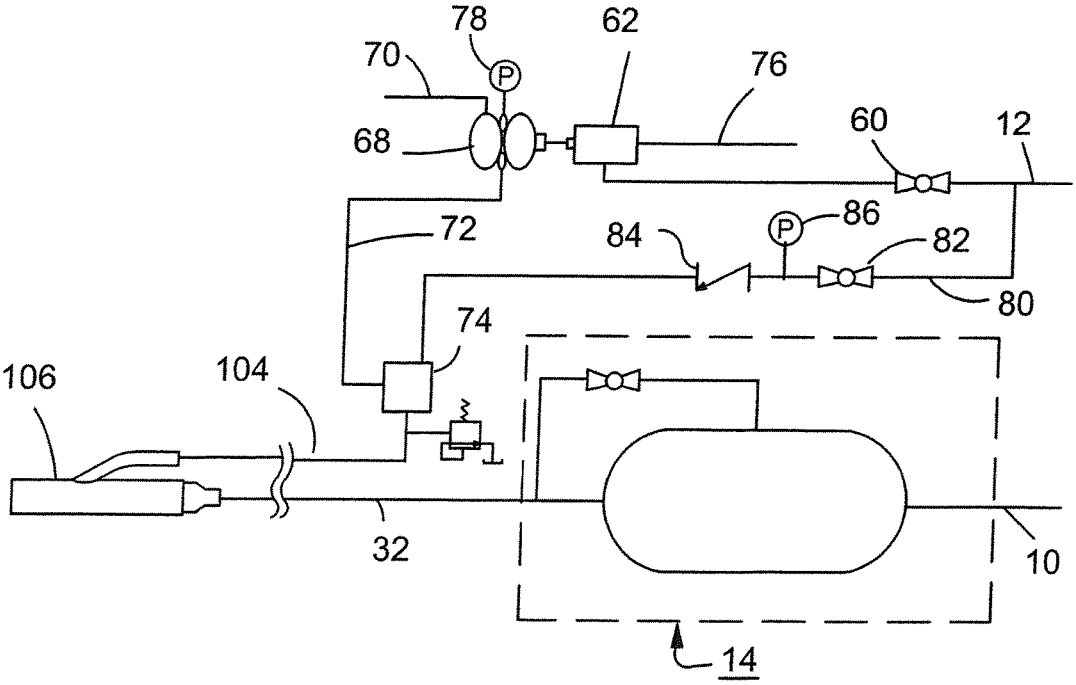
FIG. 1 is a schematic diagram of an apparatus in accordance with the invention.

In the apparatus shown in FIG. 1, compressed air is supplied through a first line 10 and through a second line 12. The compressed air can be supplied by a single compressor or by plural compressors. For the purpose of this description, line 10 and line 12 will be referred to respectively as "first and second" sources of compressed air even if they both derive air from the same compressor.

The first source is connected to a rock dust system 14, which is a known apparatus designed to draw rock dust from a supply, entrain the rock dust in air, and deliver the air-entrained rock dust through a long, flexible, conduit to an applicant site within a mine, where the rock dust is sprayed onto a mine wall.

Figure 2:
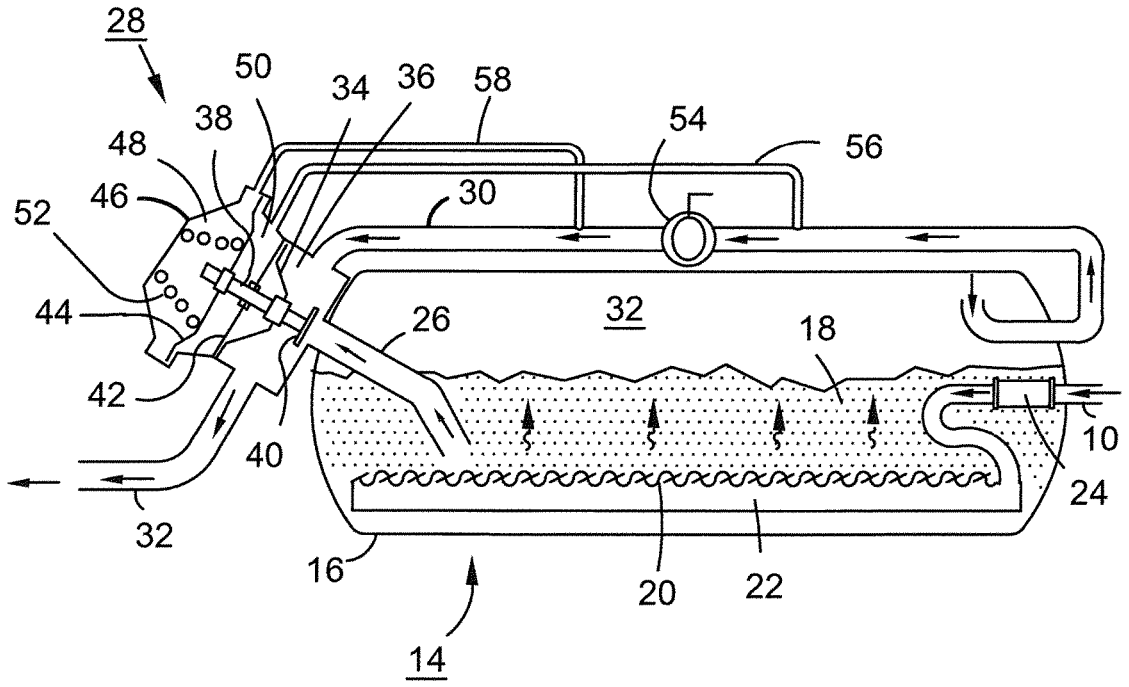
FIG. 2 is a more detailed schematic diagram of the dry rock dust entrainment apparatus which constitutes a component of the apparatus of FIG. 1.

Details of the rock dust system 14 are shown in FIG. 2. The system comprises an enclosed vessel 16 in the form of a horizontally elongated, enclosed, cylindrical, tank, which can be pressurized. A quantity of rock dust 18 is brought into the tank through a hatch (not shown) from a supply, usually above-ground. For compliance with U.S. Department of Labor regulation 30 C.F.R. § 75.2, the rock dust used in the tank should consist of "pulverized limestone, dolomite, gypsum, anhydrite, shale, adobe or other inert material, preferably light colored, 100 percent of which will pass through a sieve having 20 meshes per linear inch, the particles of which when wetted and dried will not cohere to form a cake which will not be dispersed into separate particles by a light blast of air, and which does not contain more than 5 percent combustible matter or more than a total of 4 percent free and combined silica ($SiO_2$), or, where the Secretary finds that such silica concentrations are not available, which does not contain more than 5% percent of free and combined silica."

The supply of rock dust 18 in tank 16 rests on a diffuser 20, typically a layer of cloth, below which an air chamber 22 is formed. The air chamber 22 receives air from air line 10. In an embodiment having two or more air chambers in side-by-side relationship, a diverting valve 24 can be used to divide the air flow so that each of the air chambers receives an adequate supply of air.

The air passes up through the diffuser (or through plural diffusers if more than one diffuser are provided), into the rock dust 18, causing the rock dust to take the form of a fluidized bed, from which rock dust can be drawn through a dip pipe 26, which extends into the fluidized bed to a location a short distance above the diffuser. The dip pipe leads to modulating valve 28 located outside the tank. Through a conduit 30, the modulating valve receives compressed air derived from the space 32 inside the tank above the fluidized bed. In the modulating valve 28, the rock dust flowing through the dip tube 26 is entrained in the air from conduit 30, and the mixture of air and rock dust is carried away from the modulating valve through a first conduit 32, also shown in FIG. 1.

The modulating valve includes a flexible diaphragm 34, forming a part of the wall of a mixing chamber 36, through which air flows from conduit 30 past the outlet of dip pipe 26. A stem 38 that extends through and moves with diaphragm 34 has a poppet 40 at one end, arranged to regulate flow of air and rock dust from dip pipe 26 into the mixing chamber 36. The stem also extends through a wall 42 and is connected to an operating diaphragm 44 that separates the space between wall 42 and a cover 46 into two control chambers 48 and 50. A spring 52 urges the operating diaphragm in the direction to close the poppet 40.

A valve 54 in conduit 30 is controllable to restrict the flow of air through the conduit. On the upstream side of the valve 54, the conduit 30 is connected through a tube 56 to control chamber 50, and on the downstream side, the conduit is connected through a tube 58 to control chamber 48.

The restriction of air flow by valve 54 causes a pressure drop which in turn creates a pressure differential across the operating diaphragm 44 in the modulating valve, thereby allowing the amount of dust delivered through conduit 32 to be controlled. When the aperture of valve 54 is reduced, the pressure differential across the operating diaphragm 44 cause the poppet 40 to move in the opening direction, increasing the rate of flow of dust and air from dip tube 26 into the mixing chamber 36. At the same time, the reduction of the aperture of valve 54 reduces the flow of air into the mixing chamber through conduit 30. The result is that the rate of flow of rock dust exiting through conduit 32 increases while the air flows through conduit 32 at a relatively steady rate. Thus, the valve 54 can be used to control the concentration of rock dust delivered through conduit 32.

Referring again to FIG. 1, the air in line 12 is split into two flow paths, one passing through a ball valve 60 to an air motor 62, which operates a high pressure hydraulic pump 68, arranged to deliver a foamable liquid from a supply line 70 to a line 72, which leads to a mixing block 74. Exhaust air from the air motor 62 passes to the atmosphere through line 76. A pressure gauge 78 is provided for monitoring the pressure of foamable liquid delivered to the mixing block through line 72. Valve 60 can be adjusted to control the rate of flow of foamable liquid though line 72.

The other path into which air from line 12 is split comprises line 80, another ball valve 82, and a check valve 84, the outlet of which is connected to deliver air to the mixing block 74. Valve 82 can be adjusted to control the flow of air to the mixing block. A pressure gauge 86 is provided to monitor the air pressure in the air path leading to the mixing block.

Figure 3:
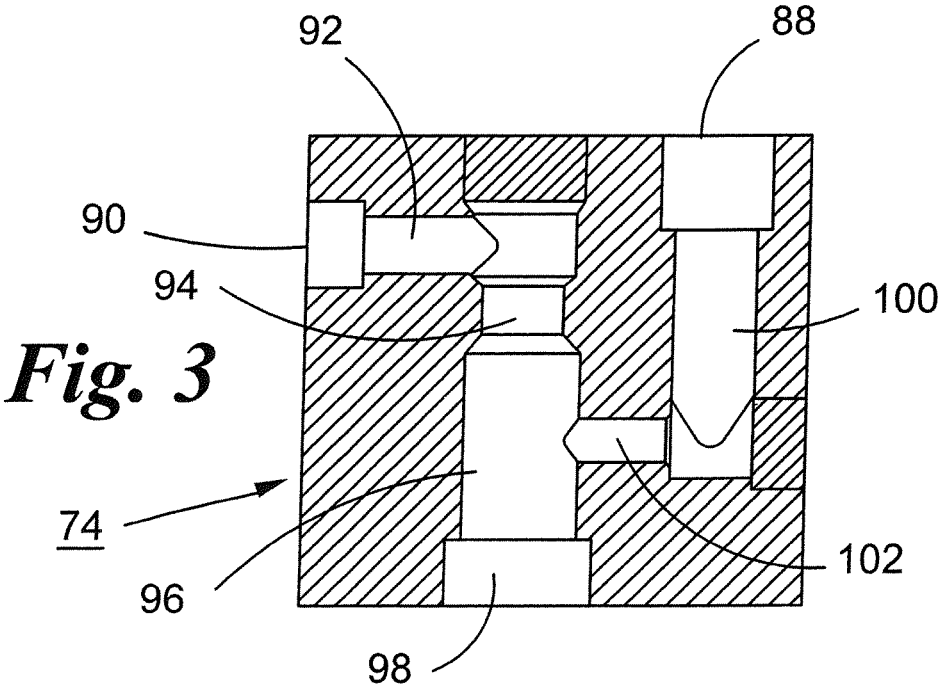
FIG. 3 is a more detailed schematic diagram of the foam/air mixing device which constitutes a component of the apparatus of FIG. 1.

As shown in FIG. 3, the mixing block 74 comprises a metal block having internal passages. Compressed air delivered through check valve 84 (FIG. 1) enters the block though an opening 88 and diluted foam concentrate, delivered as a liquid by pump 68 through line 72, enters the block through opening 90. The diluted foam concentrate flows through passage 92 and restriction 94 into a mixing chamber 96 having an outlet 98. Compressed air flows through passage 100 and into the mixing chamber 96 through a restricted passage 102, which meets the side of mixing chamber 96 so that the flow of compressed air into mixing chamber 96 is perpendicular to the direction of flow of the liquid foam concentrate. Turbulence in the mixing chamber produces the foam that is delivered through outlet 98. The mixing block regulates the flow of diluted foam concentrate and compressed air to maintain proper proportions.

Referring again to FIG. 1, the outlet of the mixing block is connected through a conduit 104 to a Y-joint 106, in which foam in conduit 104 and rock dust entrained in air in conduit 32 are mixed.

Figure 4:
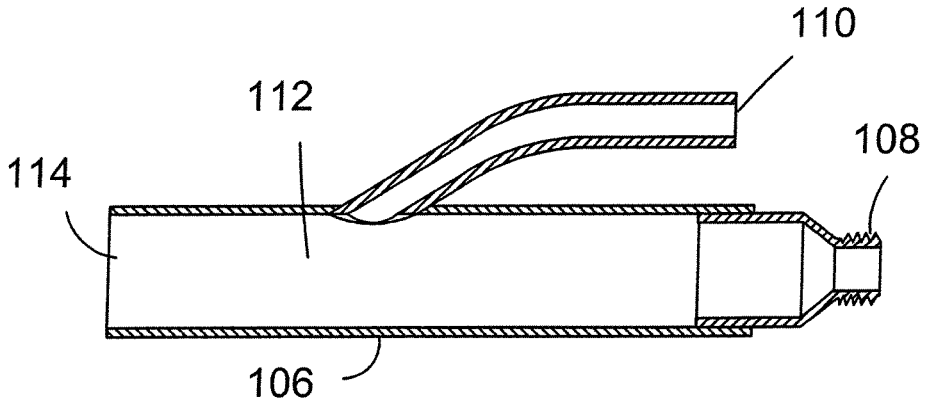
FIG. 4 is a detailed schematic diagram of the Y-joint and nozzle structure for application of a foam and rock dust mixture to a mine surface.

As shown in FIG. 4, the Y-joint 106 comprises a coupling 108 for connection to rock dust conduit 32, and a side inlet 110 for connection to the foam conduit 104. The side inlet 110 delivers the foam into an elongated interior chamber 112 aligned with the coupling 108. The foam and rock dust are mixed in chamber 112, and the mixture is delivered through a discharge nozzle 114 at the end of chamber 112 remote from coupling 108.

All or parts of the rock dust conduit 32 and the foam conduit 104 can be flexible, allowing an operator to aim the nozzle for application of a foam and rock dust mixture to a mine surface.

The foamable liquid delivered to pump 68 through line 70 (FIG. 1) can be prepared by dilution of a foam concentrate with water. A suitable foam concentrate is composed of an anionic surfactant and a carboxylic acid salt, described in U.S. Pat. No. 4,874,641, granted Oct. 17, 1989, the disclosure of which is here incorporated by reference. The foam exhibits a high degree of stiffness and longevity, making it especially suitable for application along with rock dust to a mine surface. Optionally, a quantity of a thickener such as hydroxypropylmethylcellulose to the foam concentrate can be added to increase foam stability and increase foam volume.

An example of a suitable foam concentrate described in U.S. Pat. No. 4,874,641 is one composed of 4% by weight sodium a-olefin sulfonate (100% active basis), 3.6% by weight stearic acid (100% active basis), 0.71% by weight potassium hydroxide, and 91.69% by weight, water. Any of the compositions described in U.S. Pat. No. 4,874,641, as well as many other known foaming compositions, can be used. The foam concentrate can be diluted with water to a ratio as high as approximately 10:1.

Another foam concentrate that can be used is one composed of 4% by weight sodium a-olefin sulfonate (100% active basis), 5% by weight stearic acid (100% active basis), 0.71% by weight potassium hydroxide, and 90.29% by weight, water. This concentrate can be utilized effectively at dilution ratios (water to concentrate) up to about 10:1. Significantly lower dilution ratios can be used, but reducing the dilution ratio below 7:1 has little if any beneficial effect, and can increase operating costs unnecessarily.

As mentioned above, the function of the mixing block is to maintain proper proportions of the diluted foam concentrate and compressed air. In the case of a diluted foam concentrate having the composition described above, a desirable proportion is from 2.75 to 3 cubic feet of compressed air (at approximately 100 psi) for each gallon of liquid. The apertures of the restrictions in the mixing block are chosen accordingly. The sizes of the apertures, of course, also affect the rate of foam delivery.

The ratio of air to liquid in the foam generated in the mixing block 74 can be adjusted by control valves 60 and 82 (FIG. 1). Changes in air flow to the mixing block resulting from changes in the pressure in air line 12 are compensated by changes in the rate of flow of foamable liquid through pump 68. The ratio of air to foamable liquid is regulated accordingly.

In the operation of the apparatus of FIG. 1, foam generated in the mixing block is carried to the point of application to a mine surface by conduit 104 while rock dust entrained in air is carried to the point of application by conduit 32. The foam, rock dust, and air are combined in the Y-joint 106, and sprayed onto the mine surface by nozzle 114. The Y-joint/nozzle assembly can be hand-held, or moved by robotic machinery.

The concentration of rock dust in air in conduit 32 is controlled by valve 54 (FIG. 2) and regulated by the operation of the modulating valve 28.

The proportion of foam to rock dust can vary considerably, and will depend to a large extent on the personal preference of the individual who carries the nozzle and applies the foam/rock dust mixture to a mine wall. In general, if the mixture contains too much rock dust, excessive amounts of fugitive rock dust can become airborne. On the other hand, if excessive amounts of foam are used, there is not only waste of foam producing chemical, but the amount of rock dust may be insufficient to achieve the desired fire-suppressing effect.

A number of foam/rock dust compositions were produced using a foam concentrate containing 5% stearic acid, diluted with 8 parts of water to 1 part concentrate. The wet weight of the foam/rock dust composition varied from 21.78 to 69.5 Lb/ft$^3$. The water content (by weight) and the air content (by volume) of the several compositions are shown in the following table. The increasing weight of the samples corresponds to increased rock dust content, the rock dust by itself having a density of 90 Lb/ft$^3$.

TABLE

| Sample | Lb/ft$^3$ (wet) | % water | % air |
|---|---|---|---|
| 1 | 21.78 | 37.35 | 84.74 |
| 2 | 31.18 | 22.88 | 73.28 |
| 3 | 33.29 | 15.8 | 68.86 |
| 4 | 35.07 | 25.27 | 70.88 |
| 5 | 35.29 | 21.7 | 69.3 |
| 6 | 40.84 | 19.48 | 63.46 |
| 7 | 42.9 | 18.69 | 61.25 |
| 8 | 54.28 | 13.38 | 47.76 |
| 9 | 54.39 | 11.99 | 46.82 |
| 10 | 55.72 | 11.98 | 45.51 |
| 11 | 57.15 | 12.13 | 44.2 |
| 12 | 61.05 | 11.19 | 39.76 |
| 13 | 69.5 | 9.58 | 30.18 |

Samples 2-10 yielded satisfactory results, and sample 5, having a wet weight of 35.29 Lb/ft$^3$ was considered to produce the best results. Sample 1 contained too much water and samples 11-13 had too high a rock dust to water ratio. It was observed that a higher air content produced a lighter, and more readily dispersed, mixture. For that reason, an air content of at least approximately 40% by volume is preferred.

The apparatus and method of the invention produce results in common with prior methods that utilize foams in combination with rock dust. For example, fugitive dust is significantly reduced, and the foamed rock dust encapsulates coal dust particles. The invention, however, has additional advantages. As mentioned above, conventional rock dust application equipment, e.g., the apparatus shown in FIG. 2, can be utilized in the practice of the invention, so that high volumes of rock dust/foam mixture can be applied to mine surfaces easily, rapidly, and efficiently. Since mixing of the rock dust and foam takes place immediately upstream of the application nozzle, it is unnecessary to carry out the mixing of foam and rock dust as a batch process utilizing a mixing vessel. The method and apparatus can provide for delivery of the rock dust and foam to the vicinity of the application nozzle through flexible hoses over relatively long distances, so that movement of the foam generating and rock dust entrainment equipment can be minimized. Still another advantage of the invention lies in its ability to allow the operator to make adjustments of the foam/rock dust composition and density rapidly, and while at the application site in a mine, in order to meet existing conditions.

What is claimed is:

1. A method of applying rock dust to a mine wall comprising:

entraining rock dust in air in a first flexible conduit, thereby causing a mixture of rock dust and air to flow through said first flexible conduit;

causing a flowable foam to flow through a second flexible conduit;

combining said mixture of rock dust and air taken from said first flexible conduit with said flowable foam taken from said second flexible conduit in a mixing chamber within a movable assembly, said mixing chamber having inlets connected respectively to said first and second flexible conduits, thereby producing, in said mixing chamber, a mixture of rock dust, air and foam;

causing said mixture of rock dust, air and foam to flow, from said internal chamber of the movable assembly, through a nozzle connected to said movable assembly; and applying the mixture of air, rock dust and foam flowing through said nozzle to a mine wall by moving said movable assembly relative to the mine wall while aiming said nozzle at said mine wall;

wherein, unless said nozzle is restrained, the connection of said nozzle to the movable assembly causes said nozzle to move with said movable assembly whenever said movable assembly is moved relative to said mine wall.

2. The method according to claim 1, in which said inlets of the mixing chamber are branches of a Y-joint.

3. The method of claim 1, in which said flowable foam is produced by mixing a foamable liquid with air.

4. The method of claim 1, in which said nozzle is in fixed relationship to, and movable with, said movable assembly.

5. The method of claim 1, in which air and rock dust are mixed in a second mixing chamber and delivered from said second mixing chamber to said first conduit.

6. The method of claim 1, in which air and rock dust are mixed in a second mixing chamber and delivered from said second mixing chamber to said first conduit, and in which the concentration of rock dust in the mixture of air and rock dust air flowing through said first conduit is adjusted by varying the aperture of a restriction through which rock dust flows into said second mixing chamber.

7. The method of claim 1, in which air and rock dust are mixed in a second mixing chamber and delivered from said second mixing chamber to said first conduit, and in which the flow of air to be mixed with rock dust in said second mixing chamber is adjusted by varying the aperture of a restriction through which said air flows into said mixing chamber.

8. The method of claim 3, in which the mixing of a foamable liquid with air to produce a flowable foam is carried out in a mixing block, and in which the rates at which foamable liquid and air are supplied to the mixing block are independently controlled.

9. The method of claim 3, in which the mixing of a foamable liquid with air to produce a flowable foam is carried out in a mixing block, in which foamable liquid is fed under pressure into said mixing block, and in which the rates at which foamable liquid and air are supplied to the mixing block are independently controlled.

10. The method of claim 3, in which the mixing of a foamable liquid with air to produce a flowable foam is carried out in a mixing block, in which the rates at which foamable liquid and air are supplied to the mixing block are independently controlled, in which foamable liquid is pumped into said mixing block by an air-driven pump driven by air supplied by a source of compressed air through a first air valve, and in which air from said source of compressed air is supplied to said mixing block through a second air valve.

11. A method of applying rock dust to a mine wall comprising:

entraining rock dust in air in a first conduit, thereby causing a mixture of rock dust and air to flow through said first conduit;

causing a flowable foam to flow through a second conduit;

combining said mixture of rock dust and air taken from said first conduit with said flowable foam taken from said second conduit, thereby producing a mixture of rock dust, air and foam;

causing said mixture of rock dust, air and foam to flow through a nozzle; and applying the mixture of air, rock dust and foam flowing through said nozzle to a mine wall;

in which air and rock dust are mixed in a mixing chamber and delivered from said mixing chamber to said first conduit, in which the concentration of rock dust in the mixture of air and rock dust flowing through said first conduit is adjusted by controlling the flow of rock dust into said mixing chamber, in which the air to be mixed with rock dust in said mixing chamber flows into said mixing chamber through an adjustable restriction having a variable aperture, and in which the flow of rock dust into said mixing chamber is controlled in response to an air pressure drop across said adjustable restriction, said valve restricting the flow of rock dust into said mixing chamber opening to allow rock dust to flow into the mixing chamber at a greater rate as the aperture of said adjustable restriction is reduced.

12. The method of claim 11, in which the concentration of rock dust in the mixture of air and rock dust flowing through said first conduit is adjusted by varying the aperture of an adjustable restriction through which rock dust flows into said mixing chamber.

* * * * *